US005152567A

United States Patent [19]

Raber

[11] Patent Number: 5,152,567

[45] Date of Patent: Oct. 6, 1992

[54] SAFETY RELEASE HOISTING SHACKLE

[76] Inventor: Cecil Y. Raber, Box 117 Rd. #1, Spraggs, Pa. 15362

[21] Appl. No.: 786,172

[22] Filed: Oct. 31, 1991

[51] Int. Cl.[5] ..... B66C 1/34

[52] U.S. Cl. ..... 294/82.35

[58] Field of Search ..... 294/75, 82.23, 82.24, 294/82.27, 82.31–82.35, 89; 24/598.1, 598.3, 598.4, 600.4–600.8, 601.6; 59/85, 86, 93

[56] References Cited

U.S. PATENT DOCUMENTS

| | | | |
|---|---|---|---|
| 1,751,309 | 3/1930 | DeMone | 294/82.35 X |
| 1,768,484 | 6/1930 | Lotts | 294/82.35 X |
| 1,908,146 | 5/1933 | Helton | 294/75 |
| 3,462,945 | 8/1969 | Barber | 294/82.35 X |
| 3,895,836 | 7/1975 | Barnes | 294/82.35 |
| 4,216,987 | 8/1980 | Ely | 294/82.35 |

FOREIGN PATENT DOCUMENTS

| | | | |
|---|---|---|---|
| 593515 | 3/1960 | Canada | 294/82.34 |
| 703469 | 12/1979 | U.S.S.R. | 294/82.35 |
| 798018 | 1/1981 | U.S.S.R. | 294/82.35 |
| 977352 | 11/1982 | U.S.S.R. | 294/82.35 |
| 1446083 | 2/1988 | U.S.S.R. | 294/82.35 |
| 1393751 | 5/1988 | U.S.S.R. | 294/82.35 |

*Primary Examiner*—Johnny D. Cherry
*Attorney, Agent, or Firm*—Richard C. Litman

[57] ABSTRACT

A remotely released safety hoisting shackle is disclosed including a pair of elongate, flat load suspending plates suspended from a conventional rigging clevis and pin, a load suspending pin through the lower ends of the plates, a fixed, guide block attached to one of the plates, a locating snatch block attached to rigging above the locating block, and a lanyard reeved from the load suspending shackle pin through the fixed block and then through the locating block to a remote station. The pulley of the guide block is located adjacent the shackle pin so that the shackle pin is removed in a direction coincident with its long axis upon pulling on the lanyard. The other end of the shackle pin has a removable linchpin connected to a short length cable spliced to the lanyard between the locating block and the fixed block so that upon pulling on the lanyard from a remote station, the linchpin is removed first from the shackle pin and then the shackle pin is removed from the load suspending plates and a load, thus to free the shackle from a load.

8 Claims, 2 Drawing Sheets

SAFETY RELEASE HOISTING SHACKLE

FIELD OF THE INVENTION

The present invention relates to hoisting apparatus and more particularly to a hoisting shackle that may be remotely released from its load.

BACKGROUND OF THE INVENTION

In raising large and heavy elongate members, such as structural steel columns, as may frequently be required when constructing buildings, cranes are used to lift and position these columns in place. The columns are usually suspended from the crane boom rigging by a rod or pin inserted through a hole in the column web. Upon the column being lowered into place, it must be released from the rigging. This task has traditionally been performed by a worker ascending to the top of the column and manually releasing the rigging hook from the column, but this is dangerous and inefficient. Accordingly, remotely released safety shackles have been devised.

DESCRIPTION OF THE PRIOR ART

U.S. Pat. No. 1,768,484 issued Jun. 24, 1930 to William H. Lotts discloses a pin removable from a hoisting shackle and structural column directly by a rope controlled by an operator on the ground. In this patent, the rope withdrawing the pin is at an angle to the axis of the pin. Therefore, there is a tendency of the pin to bind in the holes of the hoisting shackle and in the column being released upon the line being pulled.

The inventions disclosed in U.S. Pat. Nos. 3,462,945; 3,883,170; 3,895,836; and 4,216,987 are directed to various safety shackles. In U.S. Pat. No. 3,462,945 issued Aug. 26, 1969 to Stanley Barber, a spring loaded clevis pin latch is remotely released by a lanyard pulled oppositely of the spring load. A circular shackle with a semicircular locking bolt released remotely by a Bowden cable attachment is shown in U.S. Pat. No. 3,883,170 issued May 13, 1975 to Siegfried Fricker, et al. Another remotely actuated, spring locked clevis pin release is seen in U.S. Pat. No. 3,895,836 issued Jul. 22, 1975 to Eldridge Barnes. The device is rather complex, requiring a line reeved about no fewer than three pulleys. U.S. Pat. No. 4,216,987 shows a torsion spring locked clevis pin release employing a ratchet jack which must be tugged several times against the torsion spring load to release the clevis pin.

The construction of prior art safety shackles just discussed relies heavily on springs, ratchets, and bearings. Since construction sites are frequently dirty and exposed to inclement weather, these movable parts are subject to corrosion and jamming to the point of inoperability. Material handling practice on construction sites also subjects equipment to very rough handling, which wreaks havoc with more delicate components such as springs, ratchets, and bearings. It is also possible that rough handling will bend the equipment sufficiently to render it inoperative. Furthermore, such prior art shackles are more expensive to manufacture and maintain.

SUMMARY OF THE INVENTION

By the present invention, an improved safety release hoisting shackle is provided that may be remotely released, is uncomplicated and inexpensive to manufacture, and is effective and reliable. The present invention includes an extended length, remotely released safety shackle suspended from the pin of a conventional clevis attached to a standard rig hook and steel sling. The main body of the safety shackle has an extended length so as to accommodate a column having a rig attachment hole which may be remote from the top of the column. The load suspension pin of the safety shackle has a removable linchpin so that the safety shackle is not inadvertently disengaged from the load. An extended length lanyard is attached to the safety shackle pin so that a worker may remove the pin from the safety shackle from a remote location, when the rigging is in an off load, relaxed condition after positioning of the load.

The lanyard first removes the linchpin and then withdraws the safety shackle pin. The linchpin is received in a bore through the safety shackle pin. The lanyard actuating the safety shackle has a short length cable spliced to it and attached to the linchpin so that the linchpin is removed first, thus freeing the safety shackle pin for removal from the main body of the safety shackle.

These lines are guided by pulleys strategically located so that the direction of pin withdrawal is substantially axial with the long axes of both the linchpin and the safety shackle pin, thus overcoming the aforementioned tendency to bind. Pulley location also assures that the line is supported above both pins, out of the way of the hoisting apparatus, so that the withdrawn pins may not be entangled with the hoisting apparatus.

It is a primary object of the present invention to provide a safety release hoisting shackle made of a minimum number of parts and having an extended length or reach so as to be easily attached to a column load or the like having a rig attachment hole located even somewhat distant from the top of the column.

It is another object of the invention to provide a safety release hoisting shackle with a load suspending pin removable from the shackle along a path coaxial with the shackle pin axis so the shackle pin does not bind in the shackle during removal.

It is a further object of the invention to provide a safety release hoisting shackle having a shackle pin linchpin attached to a lanyard common to both the shackle pin and linchpin so that the linchpin is withdrawn first followed by the shackle pin when the rigging is in an off load, relaxed condition.

It is still another object of the invention to provide a safety release hoisting shackle made of uncomplicated, readily available individual parts which are easily replaceable, thus to greatly reduce maintenance costs.

With these and other objects in view which will more readily appear as the nature of the invention is better understood, the invention consists in the novel combination and assembly of parts hereinafter more fully described, illustrated and claimed with reference being made to the attached drawings.

BRIEF DESCRIPTION OF THE DRAWINGS

Similar reference characters designate corresponding parts throughout the several figures of the drawings.

DESCRIPTION OF THE PREFERRED EMBODIMENT

Figure 1:
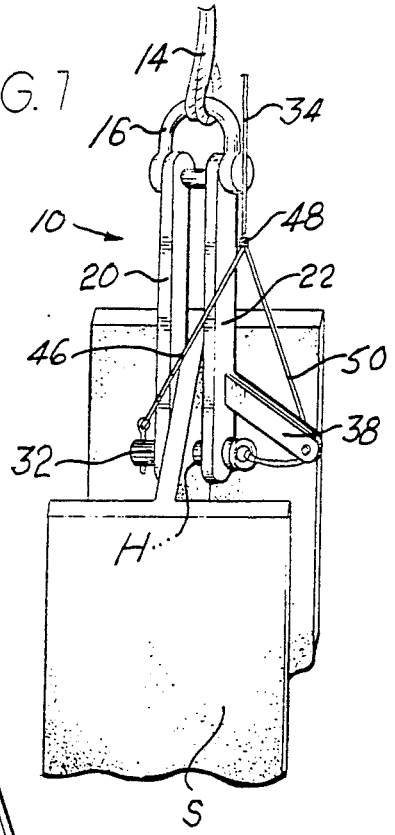
FIG. 1 is a perspective view of the invention in use and suspending a structural steel column.

The safety release hoisting shackle 10 of the present invention is seen in FIG. 1 suspending a structural steel column or I-beam S. A steel sling 14 suspended from a crane rigging hook (not shown) has a conventional screw pin anchor shackle 16.

Figure 2:
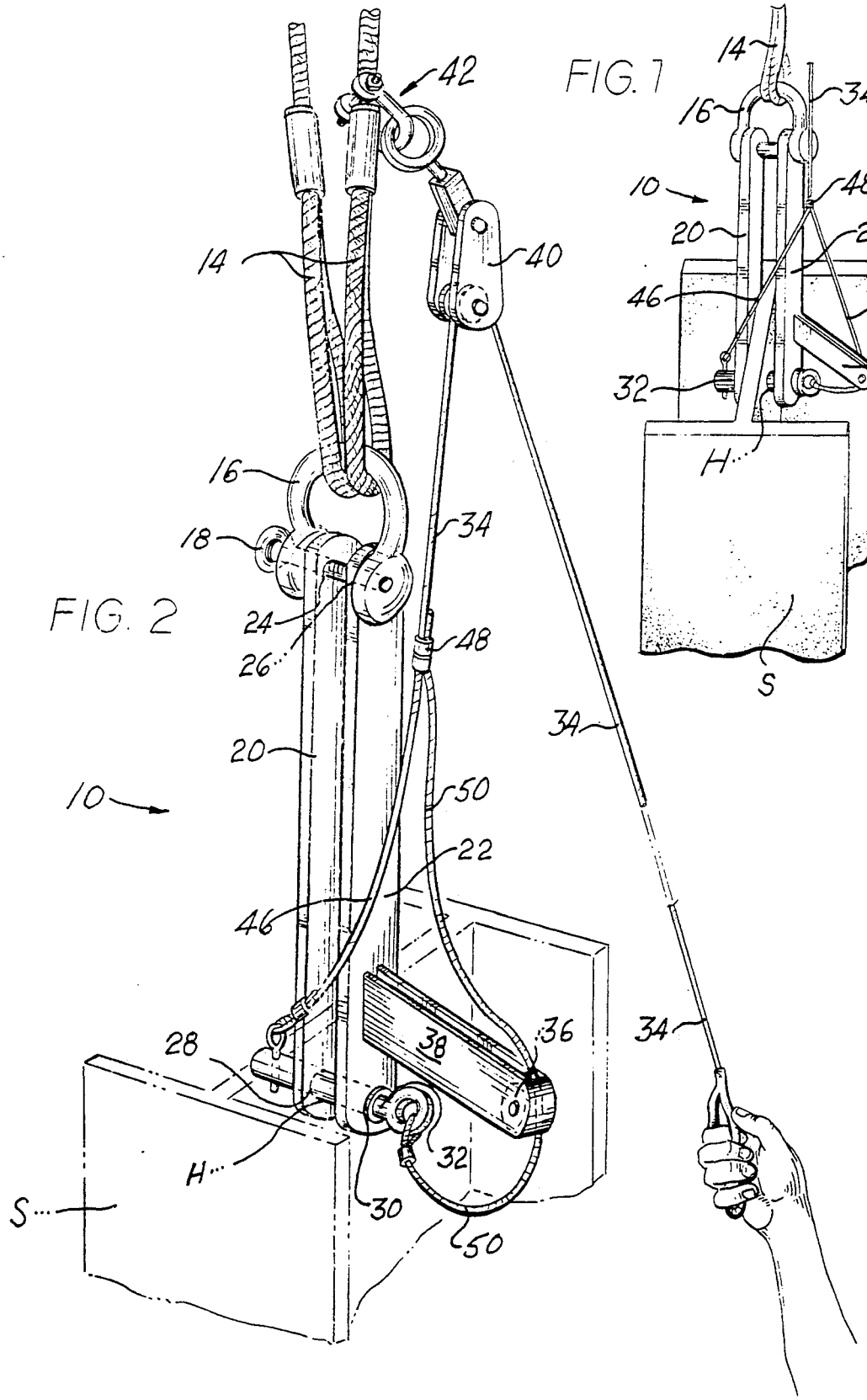
FIG. 2 is an perspective view similar to FIG. 1 but drawn to an enlarged scale.

The removable screw pin 18 of the conventional clevis or anchor shackle 16 is connected to a load S by a pair of elongated suspension plates 20, 22 having first bores 24, 26 formed through the upper ends of plates 20, 22, respectively. The plates 20, 22 form the main body of safety shackle 10. Screw pin 18 is inserted through the bores 24, 26 to suspend plates 20, 22 from anchor shackle 16 and the lower ends of the plates 20, 22 have a second pair of bores 28, 30 formed therethrough to receive a load suspending pin 32. As is seen in FIGS. 1 and 2, load pin 32 is inserted through a hole H cut through the web of structural steel column S.

Of course, it is conventional to cut the hole H in the column S so that it may be lifted and then lowered into position. The problem encountered often is that the hole H may be cut in an area of the column S web some distance below the top of the column. However, with the present invention, it is seen that the extended length plates 20, 22 impart a considerable reach to the safety shackle 10 so that a column may be easily secured to the rigging. Certainly, the reach provided by plates 20, 22 is considerable as compared to conventional anchor shackles.

An extended length lanyard 34 is attached at one end to load suspending pin 32 and is reeved through the pulley 36 of a block 38 fixed to one plate 22, and then through a locating or snatch block 40 which is removably attached to rigging or steel sling 14 as by a clevis and pin assembly 42. The snatch block is located as shown so that the lanyard 34 and attached components will be free and clear of other parts of the safety shackle after release from the load. The free end of lanyard 34 is, of course, held in the hand of a worker, as depicted in FIG. 1, who may be located at a safe station far removed from the safety shackle 10.

Figure 3:
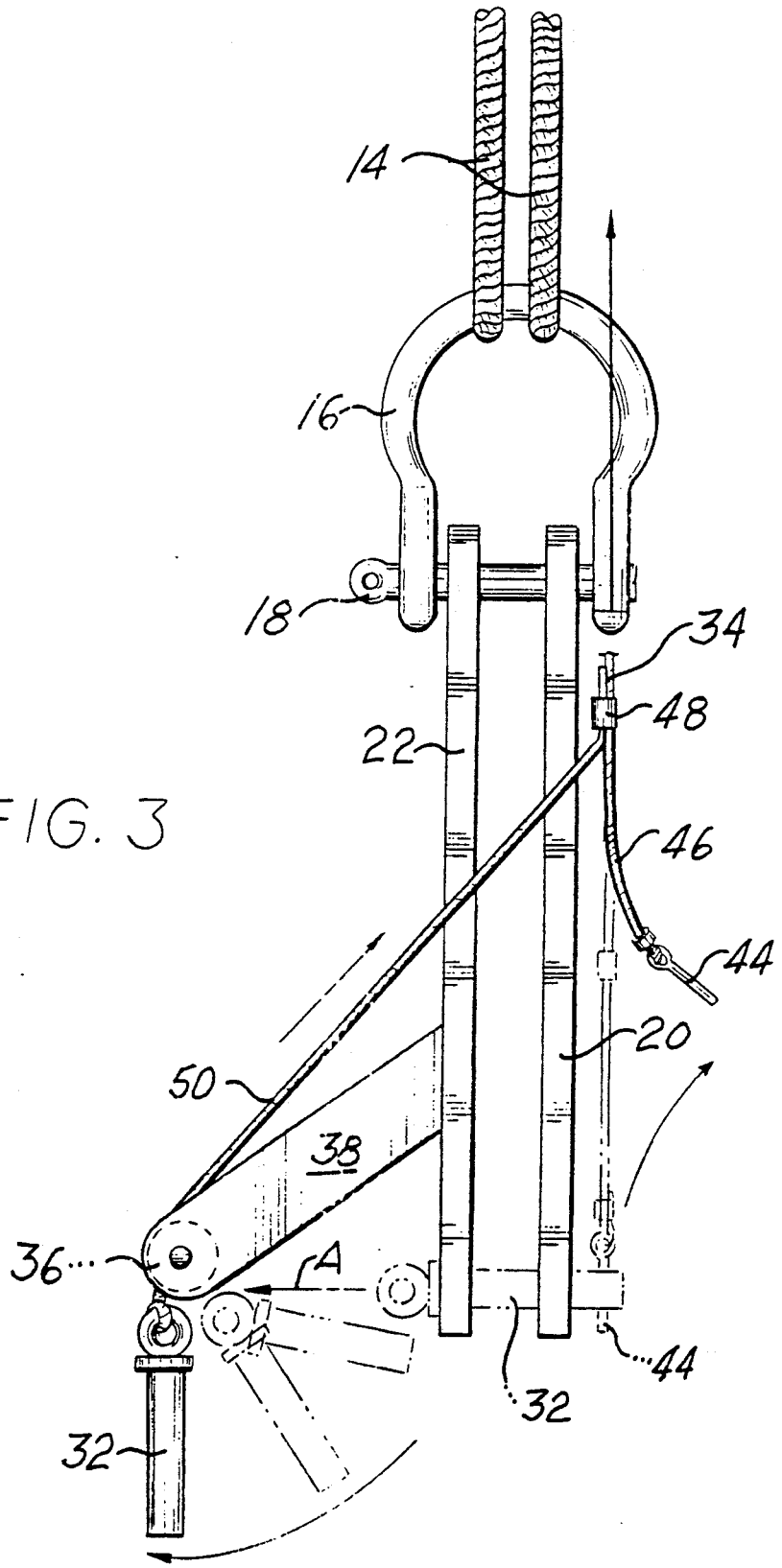
FIG. 3 is a side elevational view of the invention as shown in FIG. 2 and illustrating release of the safety shackle from a load.

With reference to FIG. 3, it is seen that the block 38 is located adjacent the lower ends of plates 20, 22 such that a pulling on lanyard 34 will remove pin 32 from the plates 20, 22 in a direction coincident with the long axis of the pin 32, or in the direction of arrow A, in the sense of FIG. 3. This action minimizes the chances that the pin 32 will bind within either the plate lower end bores 28, 30 or the hole H of the structural steel column S as the pin 32 is withdrawn after the load or column is finally positioned and the crane rigging is in an off load, relaxed condition with slack in the sling 14.

A safety latch mechanism is provided to assure that pin 32 will remain locked in place as the load is moved. As best seen in FIG. 1, the free end of load suspending pin 32 is through bored to receive a linchpin 44 therein, which is connected to a short length cable 46 spliced to lanyard 34 at 48. It is readily seen that the length of cable 46 is considerably shorter than the length 50 of lanyard 34 between splice 48 and the end of load suspending pin 32. Now, with particular reference to FIG. 3, the reason for the structure just described will become clear. After the load or column S is positioned (not shown in FIG. 3), an upward pull on lanyard 34 causes the shorter length cable to become taut first and pull linchpin 44 from the end of load suspending pin 32, as shown in phantom lines. Only then will lanyard length or segment 50 below the splice 48 become taut and a further pulling will cause the withdrawal of pin 32 from plates 20, 22 and the load in the manner previously described.

Thus, it is seen that a safety shackle is provided by the instant invention with a minimum of moving parts yet devoid of the expensive and unreliable springs, locking ratchets and Bowden cable components so common in prior art safety shackles.

As set forth above, the invention may be manufactured from readily available and easily replaced parts. As an example, plates 20, 22 and the plates making up block 38 may be cut from steel plate stock. The pulley 36 of block 38 and the snatch block 40 are available as off-the-shelf items. A simple cotter pin may be used for linchpin 44. Furthermore, it is seen that plates 20, 22 are completely separate parts. This is so that the safety shackle may be greatly reduced in size for storage purposes, and if one plate is damaged or fractured, only one plate needs to be replaced.

It is to be understood that the present invention is not limited to the sole embodiment described above, but encompasses any and all embodiments within the scope of the following claims.

I claim:

1. A remotely releasable safety hoisting shackle comprising:

a pair of elongated suspension plates having first upper ends with first bores formed therethrough for receiving the pin of a clevis suspended from rigging, and second lower ends with second bores formed therethrough;

a load suspending pin inserted through said suspension plate second bores to which a load is attached;

extended length lanyard means directly affixed to one end of said load suspending pin for pulling said load suspending pin free and clear of said load suspension plate second bores, thus to free said shackle from a load; and lanyard guide means attached to one of said suspension plates adjacent the lower end of said one suspension plate and having an outer free end for receiving said lanyard means, and maintaining that portion of said lanyard means between said load suspending pin one end and said guide means outer free end substantially coaxial with the long axis of said load suspending pin when said lanyard means is drawn taut;

whereby, upon a pulling motion exerted on said lanyard means remotely from said shackle, said load suspending pin is withdrawn from said suspension plate second bores and a load in a direction substantially coaxial with the long axis of said load suspending pin, thus to minimize binding and locking of said load suspending pin in said suspension plate second bores as said load suspending pin is removed from said shackle and a load.

2. The shackle as claimed in claim 1 wherein said shackle further comprises a locating block positioned above said lanyard guide means and through which said lanyard means is reeved, said lanyard guide means being configured as a fixed block, having a pulley mounted within said guide means outer end, said lanyard means thus being reeved from said load suspending pin one end through said lanyard guide means pulley and then through said locating block to a station remote from said shackle.

3. The shackle as claimed in claim 2 wherein said shackle further comprises safety latch means including a linchpin located in a load suspending pin end opposite said suspending pin one end, said suspending pin opposite end having a bore formed therein receiving said linchpin, and a linchpin release cable having one end attached to said linchpin and an opposite end joined by a splice to said lanyard means between said lanyard guide means free end and said locating block, the length of said linchpin release cable being shorter than the length of said lanyard means between said splice and said suspending pin one end, whereby upon a pulling motion exerted on said lanyard means remotely from said shackle, said linchpin is withdrawn first, from said load suspending pin, and said load suspending pin is then caused to withdraw from said suspension plate second bores.

4. The shackle as claimed in claim 3 wherein said locating block is a snatch block and is removably attached to rigging above the clevis.

5. The shackle as claimed in claim 2 wherein said locating block is a snatch block and is removably attached to rigging above the clevis.

6. The shackle as claimed in claim 1 wherein said suspension plates are formed as separate, distinct elongated flat segments and are joined together solely by the clevis pin received through said suspension plate first bores and said load suspending pin inserted through said suspension plate second bores.

7. A remotely releasable safety hoisting shackle comprising:

a pair of elongated suspension plates having first upper ends with first bores formed therethrough for receiving the pin of a clevis suspended from rigging, and second lower ends with second bores formed therethrough;

a load suspending pin inserted through said suspension plate second bores to which a load is attached;

extended length lanyard means attached to one end of said load suspending pin for pulling said load suspending pin free and clear of said load suspension plate second bores, thus to free said shackle from a load;

lanyard guide means attached to one of said suspension plates adjacent the lower end of said one suspension plate and having an outer free end for receiving said lanyard means, and maintaining that portion of said lanyard means between said load suspending pin one end and said guide means outer free end substantially coaxial with the long axis of said load suspending pin when said lanyard means is drawn taut;

a locating block positioned above said lanyard guide means and through which said lanyard means is reeved, said lanyard guide means being configured as a fixed block, having a pulley mounted within said guide means outer end, said lanyard means thus being reeved from said load suspending pin one end through said lanyard guide means pulley and then through said locating block to a station remote from said shackle;

safety latch means including a linchpin located in a load suspending pin end opposite said suspending pin one end, said suspending pin opposite end having a bore formed therein receiving said linchpin, and a linchpin release cable having one end attached to said linchpin and an opposite end joined by a splice to said lanyard means between said lanyard guide means free end and said locating block, the length of said linchpin release cable being shorter than the length of said lanyard means between said splice and said suspending pin one end, whereby upon a pulling motion exerted on said lanyard means remotely from said shackle, said linchpin is withdrawn first from said load suspending pin, and said load suspending pin is then withdrawn from said suspension plate second bores and a load in a direction substantially coaxial with the long axis of said load suspending pin, thus to minimize binding and locking of said load suspending pin in said suspension plate second bores as said load suspending pin is removed from said shackle and a load.

8. A remotely releasable safety hoisting shackle comprising:

a pair of elongated suspension plates having first upper ends with first bores formed therethrough for receiving the pin of a clevis suspended from rigging, and second lower ends with second bores formed therethrough;

a load suspending pin inserted through said suspension plate second bores to which a load is attached;

extended length lanyard means attached to one end of said load suspending pin for pulling said load suspending pin free and clear of said load suspension plate second bores, thus to free said shackle from a load;

lanyard guide means attached to one of said suspension plates adjacent the lower end of said one suspension plate and having an outer free end for receiving said lanyard means, and maintaining that portion of said lanyard means between said load suspending pin one end and said guide means outer free end substantially coaxial with the long axis of said load suspending pin when said lanyard means is drawn taut;

a snatch block removably attached to rigging above the clevis, said snatch block positioned above said lanyard guide means and through which said lanyard means is reeved, said lanyard guide means being configured as a fixed block, having a pulley mounted within said guide means outer end, said lanyard means thus being reeved from said load suspending pin one end through said lanyard guide means pulley and then through said snatch block to a station remote from said shackle;

safety latch means including a linchpin located in a load suspending pin end opposite said suspending pin one end, said suspending pin opposite end having a bore formed therein receiving said linchpin, and a linchpin release cable having one end attached to said linchpin and an opposite end joined by a splice to said lanyard means between said lanyard guide means free end and said snatch block, the length of said linchpin release cable being shorter than the length of said lanyard means between said splice and said suspending pin one end, whereby upon a pulling motion exerted on said lanyard means remotely from said shackle, said linchpin is withdrawn first from said load suspending pin, and said load suspending pin is then withdrawn from said suspension plate second bores and a load in a direction substantially coaxial with the long axis of said load suspending pin, thus to minimize binding and locking of said load suspending pin in said suspension plate second bores as said load suspending pin is removed from said shackle and a load.

* * * * *